United States Patent [19]

Hilal

[11] Patent Number: 5,057,645

[45] Date of Patent: Oct. 15, 1991

[54] LOW HEAT LOSS LEAD INTERFACE FOR CRYOGENIC DEVICES

[75] Inventor: Mohamed A. Hilal, Madison, Wis.

[73] Assignee: Wisconsin Alumni Research Foundation, Madison, Wis.

[21] Appl. No.: 422,642

[22] Filed: Oct. 17, 1989

[51] Int. Cl.[5] ..... H01B 12/00

[52] U.S. Cl. ..... 174/15.4; 174/15.5; 505/704; 505/884; 505/885

[58] Field of Search ..... 174/15.4, 15.5, 15.6; 336/DIG. 1; 505/1, 884, 885, 925, 926, 927; 335/216; 29/599

[56] References Cited

U.S. PATENT DOCUMENTS

| | | | |
|---|---|---|---|
| 3,518,591 | 6/1970 | Zar | 335/216 |
| 4,209,658 | 6/1980 | Hilal . | |
| 4,369,636 | 1/1983 | Purcell et al. | 62/514 R |

OTHER PUBLICATIONS

M. A. Hilal, "Optimization of Current Leads for Superconducting Systems," IEEE Transactions on Magnetics, vol. MAG-13, No. 1, Jan. 1977, pp. 690-693.

J. E. C. Williams, "Counterflow Current Leads for Cryogenic Applications," Cryogenics, vol. 3, Dec. 1963, pp. 234-238.

P. W. Mathews et al., "A Study of Heat Leaks into Cryostats Due to Electrical Leads," Cryogenics, Aug. 1965, pp. 213-215.

S. Deiness, "The Production and Otimization of High Current Leads," Cryogenics, vol. 5, Oct. 1965, pp. 269-271.

V. E. Keilin, et al., "Investigation Into High Current Leads in Liquid Helium Applications," Cryogenics, vol. 6, Aug. 1966, pp. 222-228.

C. D. Henning, "Cryogenic Electric Leads," Lawrence Radiation Laboratory, Livermore, Calif., UCR-L-14775, 1966, pp. 304-310.

K. R. Efferson, "Helium Vapor Cooled Current Leads," Rev. Sci. Instrum., vol. 38, No. 13, Dec. 1967, pp. 1776-1778.

M. N. Wilson et al., "Low Loss Heavy Curent Leads for Intermittent Use," Cryogenics, vol. 11, Nov. 1973, pp. 672-674.

T. Satow et al., "Removable Current Leads for Superconducting Magnets," ICEC, Kyoto, Japan, 1974, pp. 403-405.

F. Arendt, et al., "Design and Construction of Superconducting Quadrupole Magnets at Karlsruhe," IEEE Trans. on Magnetics, vol. MAG-13, No. 1, Jan. 1977, pp. 290-293.

R. K. Thomas, et al., "High-Current Power Leads for Tokamak Fusion Reactor Superconducting Magnets," Advances in Cryogenic Engineering, vol. 28, Plenum Press, New York, 1978, pp. 219-225.

*Primary Examiner*—Leo P. Picard
*Assistant Examiner*—Bot L. Ledynh
*Attorney, Agent, or Firm*—Foley & Lardner

[57] ABSTRACT

A lead interface for a superconducting device has a segment of normal conducting lead electrically connected to a segment of superconducting lead coiled within a dewar. The superconducting lead is adapted to be cooled to below the superconductor critical temperature by circulating a cooling fluid through an internal fluid chamber which runs the length of the superconducting coil and into an intermediate disk having an internal spiral fluid chamber. When the superconducting device is on standby, a superconducting switch is closed and the superconducting segment of the interface is left uncooled. To charge or discharge the superconducting device, the superconducting segment of the interface is cooled prior to opening the superconducting switch.

12 Claims, 3 Drawing Sheets

LOW HEAT LOSS LEAD INTERFACE FOR CRYOGENIC DEVICES

This invention was made with United States government support awarded by the Department of Defense (DOD-Navy), #00167-87-K0095. The United States Government has certain rights in this invention.

FIELD OF THE INVENTION

This invention relates generally to electric leads for devices maintained at low temperatures.

BACKGROUND OF THE INVENTION

Devices employing low temperature superconductors must be refrigerated to bring the superconducting material below the critical temperature at which the material becomes superconducting. For most superconductors this critical temperature is extremely low, often in the vicinity of the temperature of liquid helium or hydrogen. Thus, the difference between room temperature and the temperature of the superconducting device can be very large. As a result of this large temperature difference the energy lost through even the smallest thermally conductive area can be significant.

Current is usually supplied to a superconducting device from outside the refrigerated device. Normally conductive leads, often carrying very high currents, must bridge the room temperature environment of the power supply and the very low temperature environment of the superconducting device. Normal conductors of electricity—especially those designed for high current loads—are also excellent thermal conductors. Consequently, when normal conducting leads are connected to the refrigerated superconducting device, they can place a significant load on the refrigerating equipment for the superconducting device. The added power required to refrigerate the device can significantly degrade the total power efficiency of the system.

In many superconductor applications, for example in the superconducting magnets used in nuclear magnetic resonance diagnostic machines and particle accelerators, a current is only applied to the device during the charge and discharge of the device. Since the time devoted to charging and discharging the device can be very small in proportion to the time when the device need not be electrically connected to the exterior (in a standby mode), it is common practice to disconnect the electric leads into the device throughout the standby period.

Unfortunately, the mechanical joints in detachable leads reduce the reliability of the system. The mechanical joints are exposed to extreme temperature variations and a harsh environment which can lead to a connection failure that could be disastrous to the functioning of the superconducting device.

SUMMARY OF THE INVENTION

A lead interface for a superconducting device according to the invention has a segment of normal conducting lead electrically connected to a segment of superconducting lead. The superconducting lead is cooled to below the superconductor critical temperature, preferably by circulating a cooling fluid through an internal fluid chamber which runs the length of the superconducting coil and into an intermediate disk having an internal spiral fluid chamber. The intermediate disk divides the interior of a surrounding dewar into two portions, one enclosing the superconducting coil and the other a length of normal conductor. The superconducting lead and the normal conducting lead inside the dewar are electrically joined at the intermediate disk.

Because the current density for the superconducting lead segment is much higher than that of a normal conducting lead segment, the cross-sectional area of the superconducting lead is much smaller than of the normal conducting lead having the same current carrying capacity. The lower cross-sectional area of the superconducting lead, coupled with the fact that typical composite conductors are less thermally conductive than normal conductors, results during standby operation in substantially lower heat leaks into the superconducting device as compared to prior lead structures in which normal conductors penetrated the dewar for the superconducting device.

The reduced heat leaks of the lead interface of the invention obviate the need for the leads to be detachable, and thus achieve greater reliability of the leads.

Further objects, features, and advantages of the invention will be apparent from the following detailed description taken in conjunction with the accompanying drawings showing the preferred embodiment of the invention.

DESCRIPTION OF THE PREFERRED EMBODIMENT

Figure 1:
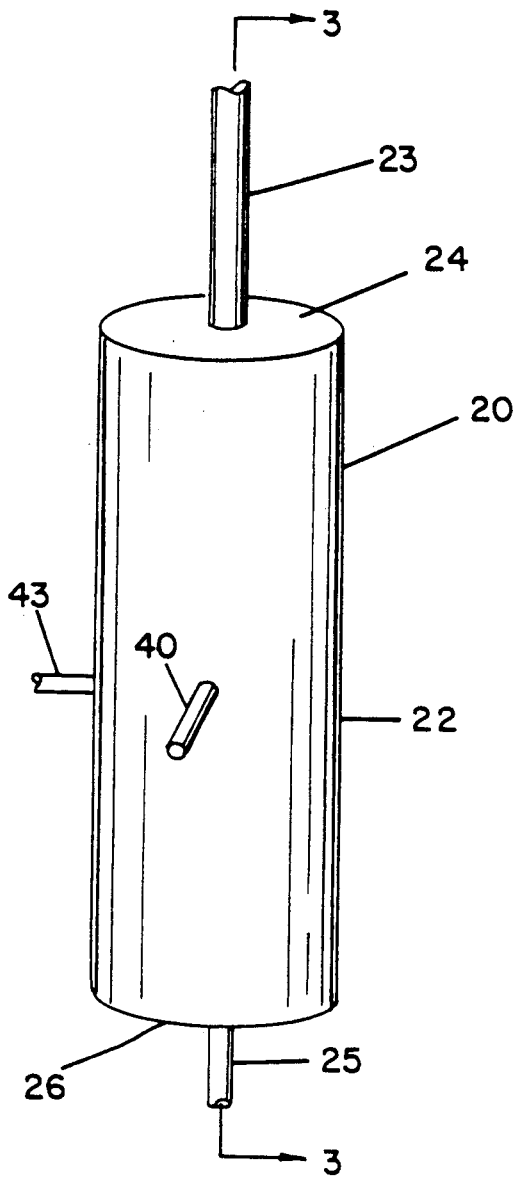
FIG. 1 is a side view of the lead interface of the invention.
Figure 3:
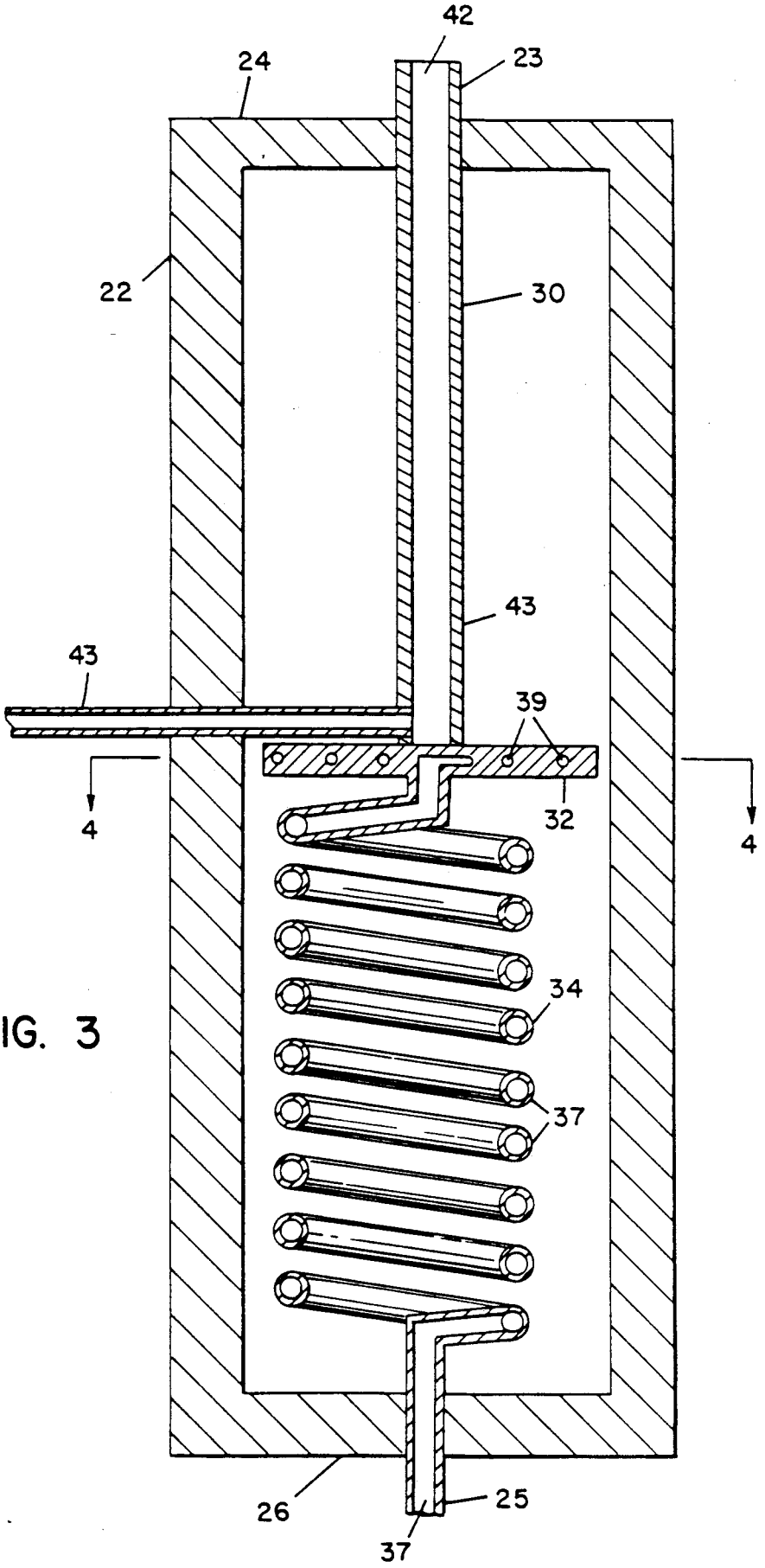
FIG. 3 is a partial cross-section of the lead system of FIG. 1 taken along the line 3—3 of FIG. 1, showing the superconducting coil segment, the intermediate disk, and the normally conducting segment of the leads.

With reference to the drawings, FIG. 1 shows the lead interface of the invention generally at 20 which has a cylindrical insulating dewar 22. A normal conducting lead 23 enters the interface 20 at the top or "warm" end 24 and a superconducting lead 25 exits the interface 20 at the bottom or "cold" end 26. The construction of the interface 20 is best shown in the cross-sectional view of FIG. 3. As shown therein, the normal conducting lead 23 enters the insulating dewar 22 at the warm end 24 and forms a normal conducting lead segment 30 within the dewar. At the intermediate disk 32, which can be a single layer of superconductive pancake winding placed in a metal disc, the normal conducting lead 30 is joined to a superconducting lead segment 34 in the dewar which is formed as a coil within the dewar and which exits the insulating dewar 22 at the cold end 26.

Figure 4:
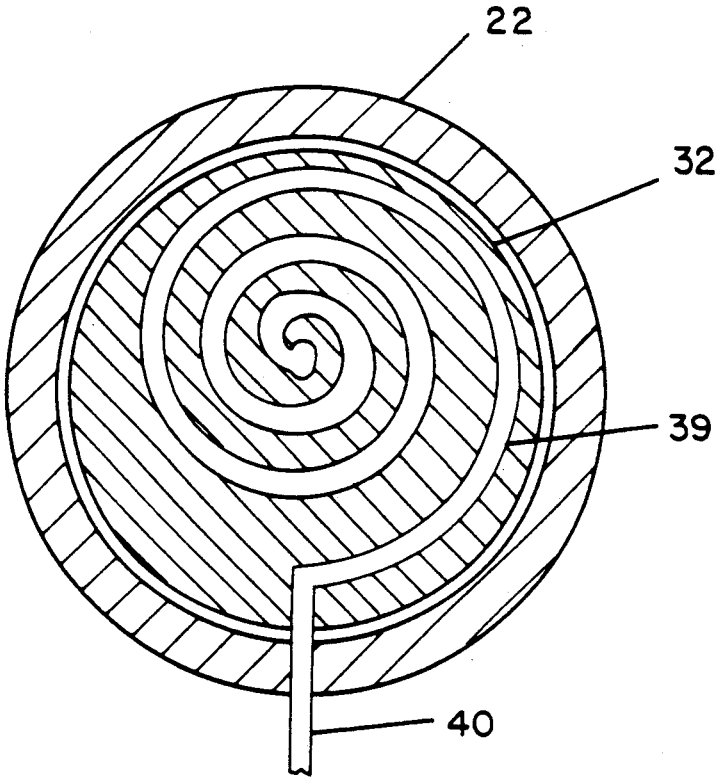
FIG. 4 is a cross-section of the intermediate disk of the lead interface taken along line 4—4 of FIG. 3.

The superconducting lead segment 34 may be formed of any appropriate superconduting material, such as Nb-Ti, $Nb_3Sn$, or YBCO compounds. The superconducting lead segment 34 has an internal fluid chamber 37 adapted to allow refrigerating fluid to circulate through the internal fluid chamber and then to exit into the internal spiral fluid chamber 39 in the disk 32. As shown in FIG. 4, the fluid may pass through the internal spiral fluid chamber 39 and exit the dewar 22 at refrigerant exit pipe 40. The normal conducting lead segment 30 is adapted to be separately cooled by refrigerant fluid traveling through an internal fluid chamber 42 and which may exit at a refrigerant exit pipe 43.

Figure 2:
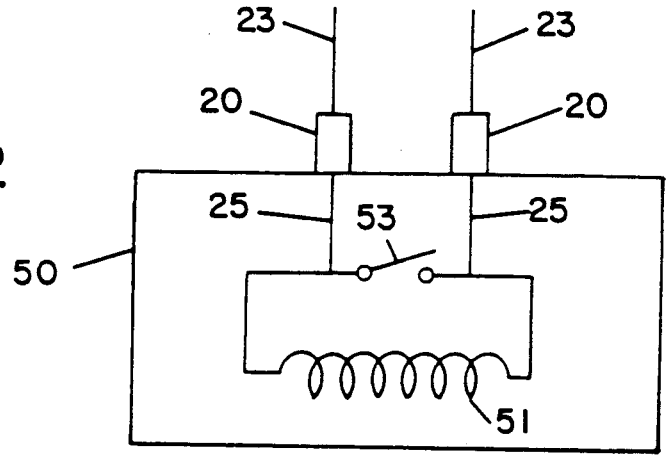
FIG. 2 is a simplified schematic circuit diagram showing the lead interfaces of the invention connected to an exemplary superconducting device.

As illustrated in FIG. 2, the interface 20 can be non-detachably attached to a dewar 50 or other insulating container housing a superconducting device 51, such as a magnetic coil. Two interfaces 20 generally will be used, one for the supply current and one for the return current. The superconducting leads 25 are connected in the dewar 50 to the appropriate terminals of the superconducting device 51. The same refrigerating fluid which is cooling the superconducting device may enter the internal fluid chambers 37 within leads 25 at a refrigerant connection (not shown). This refrigerating fluid may typically be hydrogen or helium, but it may be any refrigerating fluid which is at low enough temperatures to maintain the superconducting leads below the superconductor critical temperature. The refrigerating fluid flows through the internal fluid chamber 37 in the superconducting leads segment 34 and cools it below the superconductor critical temperature. The refrigerating fluid enters the internal spiral fluid chamber 39 of the intermediate disk 32 and then exits the interface 20 at the refrigerant exit pipe 40. The refrigerating fluid may be recirculated through an external refrigerator (not shown) which is preferrably the same refrigerator acting to cool the superconducting device.

In a typical mode of operation, when the superconducting device 51, for example a superconducting magnet, is in a standby mode, a superconducting switch 53 is closed and no current flows through the superconducting leads 25. In the standby mode the normally conducting lead segment 30 is not cooled and attains a temperature above the superconducter critical temperature. The surface of the intermediate disk 32 connected to the normally conducting lead segment 30 is, in the standby mode, at a higher than critical temperature. Since the cross-section of the superconducting lead segment engaging the intermediate disk 32 is relatively small, and the helical form of the segment 34 gives it a relatively long length, the heat transfer from the disk 32 to the superconducting lead 25 outside the dewar 22 is at a relatively low rate, compared to the heat conduction through an appropriately sized normal conducting lead which would be required to extend into the dewar 50.

When a voltage difference is applied to the circuit across the normally conducting leads 23 so that a current is flowing through the interfaces 20 into and out of the superconducting device, for example, during the charge or discharge of a superconducting magnet, the normal conducting lead segment 30 may also be cooled, preferably by a separate cooling loop entering the normal conducting lead segment 30 through the refrigerant channel 42 and leaving the normal conducting lead segment 30 at the refrigerant exit 43. In a typical method of operation, prior to the time the switch 53 is opened, refrigerant is circulated through the superconducting lead segments 34 to cool them and the disk 32 below the superconducting critical temperature, after which the switch 53 is opened. The superconducting lead segments 34 will thus be superconducting during this time so that no heat from electrical resistance will be generated in the lead segment 34. Cooling of the disk 32 below the critical temperature ensures that the portion of the superconducting segment 34 joined to the normal conducting disk 32 (e.g., formed of high purity copper) will remain superconductive and that any heat from the normal conducting segment 43 will be drawn into the disk and transferred to the refrigerant fluid flowing through the disk.

It should be understood that an interface according to the invention may be constructed with varying lengths of superconducting and normally conducting leads, with superconducting coiled leads of varying radii, and with intermediate disks of differing radii and thickness. Also the insulating chamber may be of a shape other than a cylindrical one. Furthermore, the normally conducting leads may be fabricated of any normally conducting substance, although preferrably constructed of a high-purity normally conducting material such as copper, and the superconducting leads may be fabricated of any of the appropriate well known superconducting materials, which will typically be composite conductor constructions.

It is understood that the invention is not confined to the particular construction and arrangement of parts herein illustrated and described, but embraces such modified forms thereof as come within the scope of the following claims.

What is claimed is:

1. An interface between a normal conducting lead and a superconducting lead comprising:

(a) a normal conducting lead segment electrically continuous with the normal conducting lead;

(b) a superconducting lead segment electrically continuous with the superconducting lead;

(c) an intermediate segment at which the normal conducting lead segment and the superconducting lead segment are electrically joined;

(d) an insulating dewar surrounding the superconducting lead segment and from which the superconducting lead segment exits;

(e) means for allowing the superconducting lead segment and the intermediate segment to be cooled below the superconductor critical temperature of the superconducting lead segment including a channel in and extended through the superconducting lead segment and in communication with a channel in the intermediate segment, whereby a coolant may be passed through the channel to cool the superconducting lead segment and the intermediate segment.

2. The interface of claim 1 wherein the superconducting lead segment is coiled within the dewar, with each turn of the coil spaced from adjacent turns to thermally isolate turns of the coil from each other.

3. An interface between a normal conducting lead and a superconducting lead comprising:

(a) a normal conducting lead segment electrically continuous with the normal conducting lead;

(b) a superconducting lead segment electrically continuous with the superconducting lead;

(c) an intermediate segment at which the normal conducting lead segment and the superconducting lead segment are electrically joined;

(d) an insulating dewar surrounding the superconducting lead segment and from which the superconducting lead segment exits, wherein the insulating dewar surrounds the normal conducting lead segment and the intermediate segment comprises a disk which divides the dewar into two portions and connects the normally conducting lead segment to the superconducting lead segment;

(e) means for allowing the superconducting lead segment and the intermediate segment to be cooled below the superconductor critical temperature of the superconducting lead segment.

4. The interface of claim 3 wherein the means for allowing the cooling includes a channel extended through the superconducting lead segment and in communication with a channel formed in the disk, whereby a coolant may be passed through the channel to cool the superconducting lead segment and the disk.

5. The interface of claim 4 wherein the channel in the disk is formed as a spiral which extends from a central connection to the superconducting lead segment to a port formed in the dewar from which coolant may exit.

6. An interface between a normal conducting lead and a superconducting lead comprising:

(a) a normal conducting lead segment electrically continuous with the normal conducting lead;

(b) a superconducting lead segment electrically continuous with the superconducting lead;

(c) an intermediate segment at which the normal conducting lead segment and the superconducting lead segment are electrically joined;

(d) an insulating dewar surrounding the superconducting lead segment and from which the superconducting lead segment exits;

(e) means for allowing the superconducting lead segment and the intermediate segment to be cooled below the superconductor critical temperature of the superconducting lead segment;

wherein the normally conducting lead segment is surrounded by the dewar and has a channel formed in it for passing a coolant through it to cool the normally conducting lead segment to approximately the temperature of the superconducting segment.

7. An electrical system comprising:

(a) a superconducting device having a current loop and a superconducting switch in the loop;

(b) a dewar surrounding the device and switch;

(c) two interfaces having normal conducting leads extending from each for connecting to a source or consumer of power and superconducting leads exiting from each interface into the dewar surrounding the device and switch and connected to the current loop on either side of the switch, wherein each interface comprises:

a normal conducting lead segment electrically continuous with one of the normal conducting leads;

a superconducting lead segment electrically continuous with one of the superconducting leads;

an intermediate segment at which the normal conducting lead segment and the superconducting lead segment are electrically connected;

an insulating dewar surrounding the superconducting lead segment and from which the superconducting lead segment exits; and means for allowing the superconducting lead segment and the intermediate segment to be cooled below the superconducter critical temperature of the superconducting lead segment.

8. The electrical system of claim 7 wherein the superconducting lead segment is coiled within the dewar, with each turn of the coil spaced from adjacent turns for thermal isolation.

9. The electrical system of claim 7 wherein the insulating dewar surrounds the normal conducting lead segment and the intermediate segment comprises a disk which divides the dewar into two portions and connects the normal conducting lead segment to the superconducting lead segment.

10. The electrical system of claim 9 wherein the means for allowing cooling includes a channel extended through the superconducting lead segment and in communication with a channel in the disk, whereby a coolant may be passed through the channel to cool the superconducting lead segment and the disk.

11. The interface of claim 10 wherein the channel in the disk is formed as a spiral which extends from a central connection to the superconducting lead segment to a port formed in the dewar from which coolant may exit.

12. The electrical system of claim 7 wherein the normally conducting lead segment is surrounded by the dewar and has a channel formed in it for passing a coolant through it to cool the normally conducting lead segment to approximately the temperature of the superconducting segment.

* * * * *